US007116196B1

(12) United States Patent
Hirabayashi

(10) Patent No.: US 7,116,196 B1
(45) Date of Patent: Oct. 3, 2006

(54) STARTER ELECTROMAGNETIC SWITCH

(75) Inventor: Takashi Hirabayashi, Chita-gun (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/391,285

(22) Filed: Mar. 29, 2006

(30) Foreign Application Priority Data

Mar. 31, 2005 (JP) ..... 2005-101611

(51) Int. Cl.
*H01F 5/00* (2006.01)

(52) U.S. Cl. ..... 335/282; 335/126; 335/131

(58) Field of Classification Search ..... 335/126, 335/131, 282
See application file for complete search history.

(56) References Cited

U.S. PATENT DOCUMENTS 3,571,770 A * 3/1971 Dew ..... 335/256
5,757,256 A * 5/1998 Vilou ..... 335/126
5,801,607 A * 9/1998 Duverger ..... 335/126

FOREIGN PATENT DOCUMENTS

JP A 2004-111231 4/2004

OTHER PUBLICATIONS

U.S. Appl. No. 11/266,370, filed Nov. 4, 2005, Hirabayashi et al.

* cited by examiner

*Primary Examiner*—Ramon M. Barrera
(74) *Attorney, Agent, or Firm*—Oliff & Berridge PLC

(57) ABSTRACT

The starter electromagnetic switch includes a switch coil creating magnetic force to move a plunger for closing the main contact thereof, a switch terminal bolt having a head portion fixed to a switch cover covering the main contact, and a shaft portion to which a switch cable is fastened by tightening a nut thereto, and a conducting plate for electrically connecting the switch coil and the switch terminal bolt to each other. The conducting plate has a mounting hole formed therein. The shaft portion is passed through the mounting hole without making contact with the conducting plate. The conducting plate is supported by the switch cover in a state where a certain distance is kept with a bearing surface of the switch terminal bolt when the nut is not tightened to the shaft portion.

10 Claims, 8 Drawing Sheets

STARTER ELECTROMAGNETIC SWITCH

CROSS-REFERENCE TO RELATED APPLICATION

This application is related to Japanese Patent Application No. 2005-101611 filed on Mar. 31, 2005, the contents of which are hereby incorporated by reference.

BACKGROUND OF THE INVENTION

1. Field of the Invention

The present invention relates to a starter electromagnetic switch for controlling supply of electric power to a starter motor.

2. Description of Related Art

As disclosed, for example, in Japanese Patent Application Laid-open No. 2004-111231, such a starter electromagnetic switch includes a switch coil connected to a key switch through a switch terminal. This switch coil serves as an electromagnet which creates an attraction force when the key switch is turned on to supply the switch coil with a current from a battery. A plunger, which is slidably installed inside the switch coil, is attracted to a stationary iron core forming a magnetic circuit of the electromagnet (switch coil) when the electromagnet creates the attraction force, to thereby close a main contact of a starter motor. When the key switch is turned off, the attraction force disappears, and accordingly the plunger is put back under the action of a bias spring, to thereby open the main contact.

The starter electromagnetic switch is installed on the starter before the starter is mounted on a vehicle. Such a conventional starter electromagnetic switch has a problem in that, if the switch terminal thereof is accidentally applied with a voltage, the plunger is moved, causing a pinion of the starter to project unintentionally. Accordingly, it has been necessary to pay careful attention so as not to apply a voltage by mistake to the switch terminal until the starter is mounted on the vehicle, and a specific switch cable is connected to the switch terminal.

SUMMARY OF THE INVENTION

The present invention provides a starter electromagnetic switch having a main contact through which electric poser is supplied to a motor starter of a vehicle engine, the electromagnetic switch including:

a switch coil creating a magnetic force to move a plunger slidably disposed in the switch coil for closing the main contact when a current is supplied to the switch coil;

a switch terminal bolt having a head portion fixed to a switch cover made of insulating material and covering the main contact, and a shaft portion to which a vehicle side switch cable is fastened by tightening a nut to the shaft portion; and a conducting plate located outside the switch cover for electrically connecting the switch coil and the switch terminal bolt to each other;

wherein the conducting plate has a mounting hole formed therein, the shaft portion being passed through the mounting hole without making contact with the conducting plate, the conducting plate being supported by the switch cover in a state where a certain distance is kept with a bearing surface of the switch terminal bolt when the nut is not tightened to the shaft portion of the switch terminal bolt.

According to the present invention, the conducting plate does not make electrical contact with the switch terminal bolt until a vehicle side switch cable is fastened to the switch terminal bolt by tightening a nut to the switch terminal bolt. Accordingly, even if the switch terminal bolt is accidentally applied with a voltage, the switch coil is not energized, and the electromagnetic switch is not therefore activated. This makes it possible to prevent the plunger from moving unintentionally. Hence, with this invention, the work of mounting the starter on the vehicle can be performed safely, since there is no fear of the pinion of the starter projecting unintentionally.

The surface of the head portion of the switch terminal bolt on the side of the shaft portion may serve as the bearing surface, the head portion being partially embedded in the switch cover in a state where the bearing surface projects from an outer surface of the switch cover.

The conducting plate may be bent in a thickness direction to have a crank-like shape, one end side of the conducting plate being held in a supporting surface of the switch cover, the other end side of the conducting plate having the mounting hole formed therein, a bend height of the conducting plate is larger than a height between the supporting surface of the switch cover and the bearing surface of the switch terminal bolt.

The switch cover may have a wall portion formed in the outer surface thereof, the wall portion surrounding the one end side of the conducting plate to fix a position of the other end side of the conducting plate.

The conducting plate may be bent in a thickness direction to have an L-like shape, one end side of the conducting plate being inserted into a slit groove formed in the outer surface of the switch cover, the other end side of the conducting plate having the mounting hole formed therein, a length of the one end side being larger than a height between a bottom surface at which a front edge of the one end side abuts and the bearing surface of the switch terminal bolt.

The slit groove formed in the outer surface of the switch cover may have substantially the same size in cross section as the other end side of the conducting plate.

The switch cover may have a hole therein extending opposite to the shaft portion of the switch terminal bolt, the hole being formed by pulling out a rod-like jig used for positioning the head portion of the switch terminal bolt when the switch terminal bolt is insert-molded in the switch cover, the hole being closed by a sealing packing put between the switch cover and a solenoid casing containing the switch coil.

The head portion of the switch terminal bolt may have such a shape that prevents the switch terminal bolt from turning together with the nut when the nut is tightened to the shaft portion of the switch terminal bolt.

The starter electromagnetic switch of the invention may have a switch terminal to which an end of the switch coil is connected within the switch cover, one end of the switch terminal being extended to expose outside the switch cover, the conducting plate having a junction portion by which the one end of the switch terminal is pinched for electrical and mechanical connection with the conducting plate.

The one end of the switch terminal may be heat-crimped to the junction portion.

PREFERRED EMBODIMENTS OF THE INVENTION

First Embodiment

Figure 1:
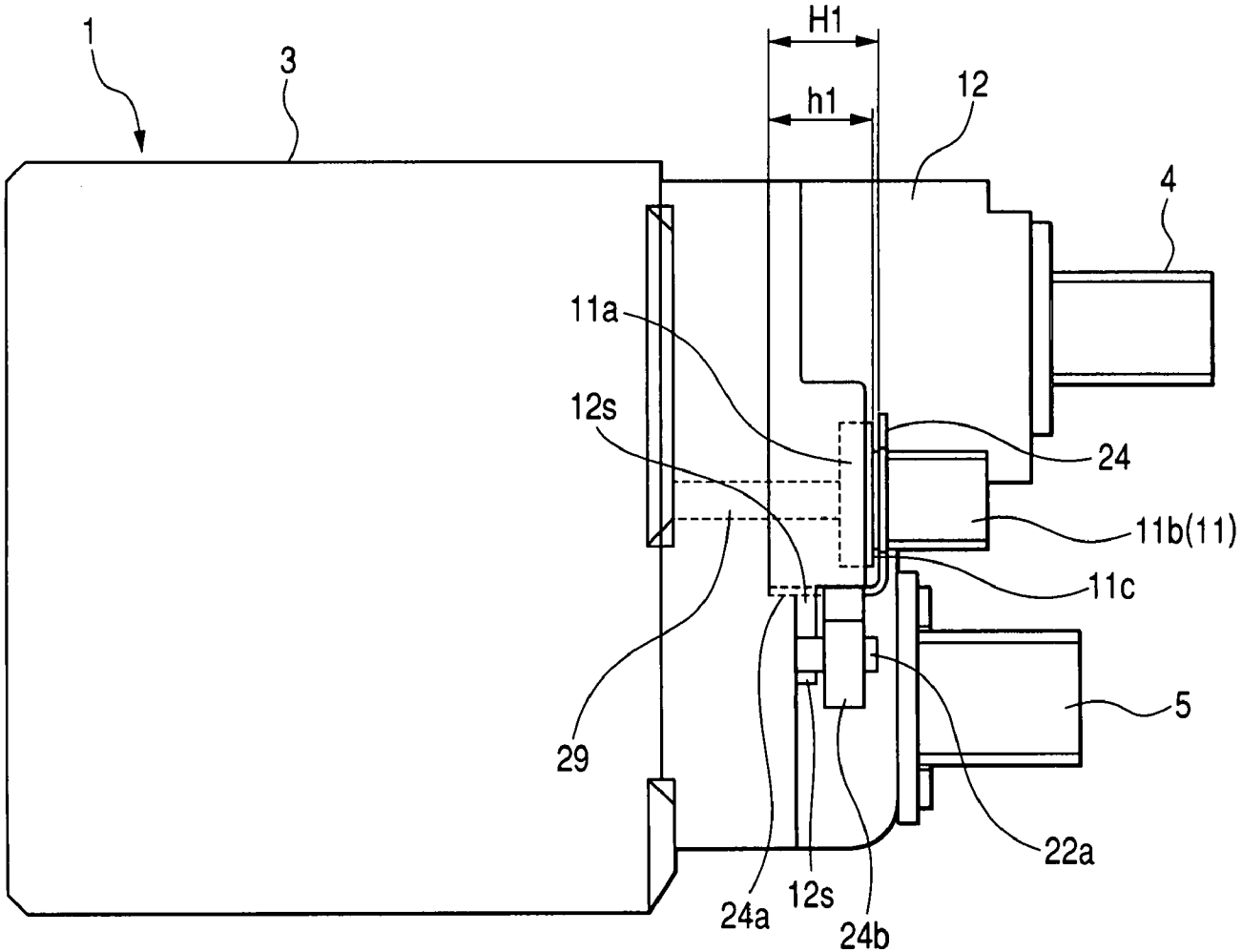
FIG. 1 is a side view of a starter electromagnetic switch according to a first embodiment of the invention.
Figure 2:
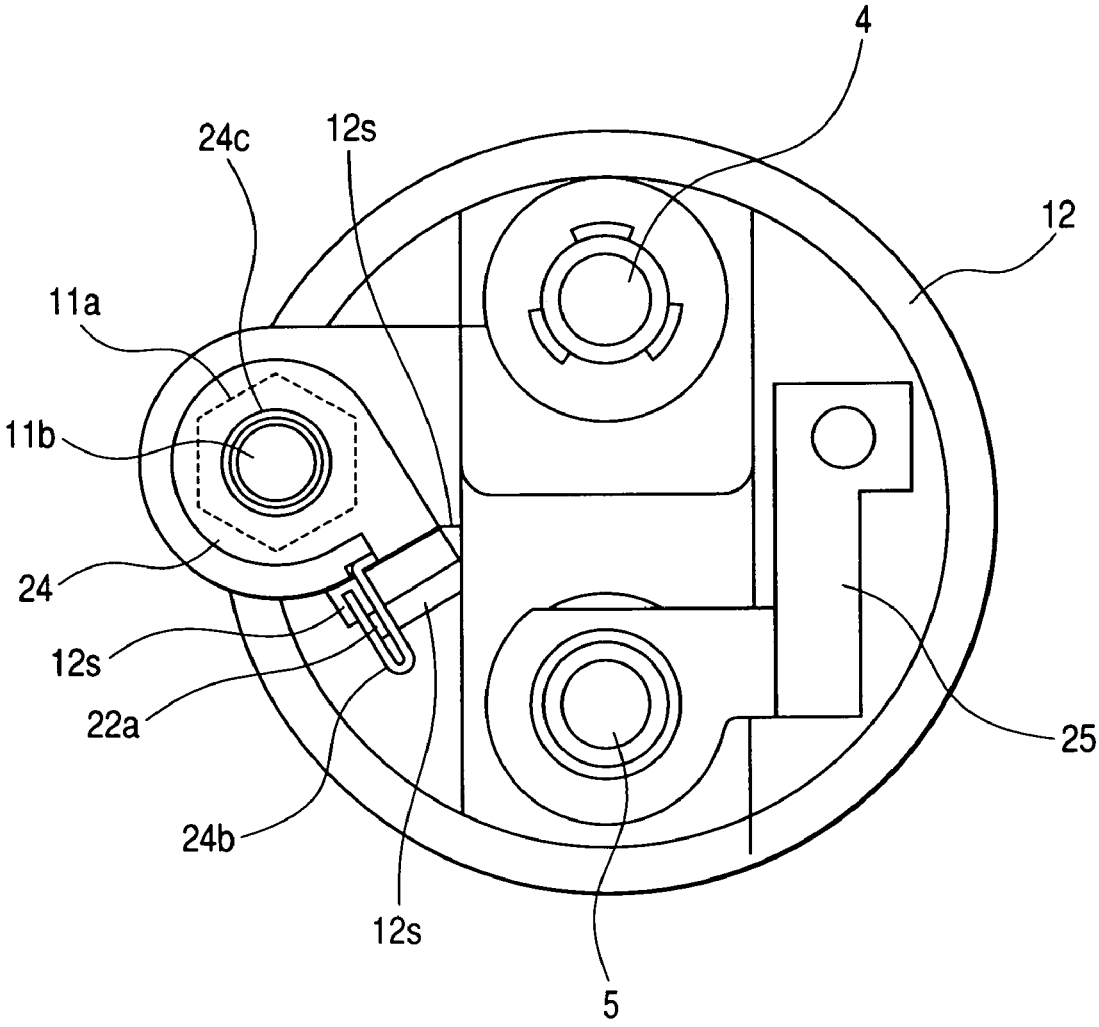
FIG. 2 is a front view of the starter electromagnetic switch viewed from the side of a switch cover thereof.
Figure 3:
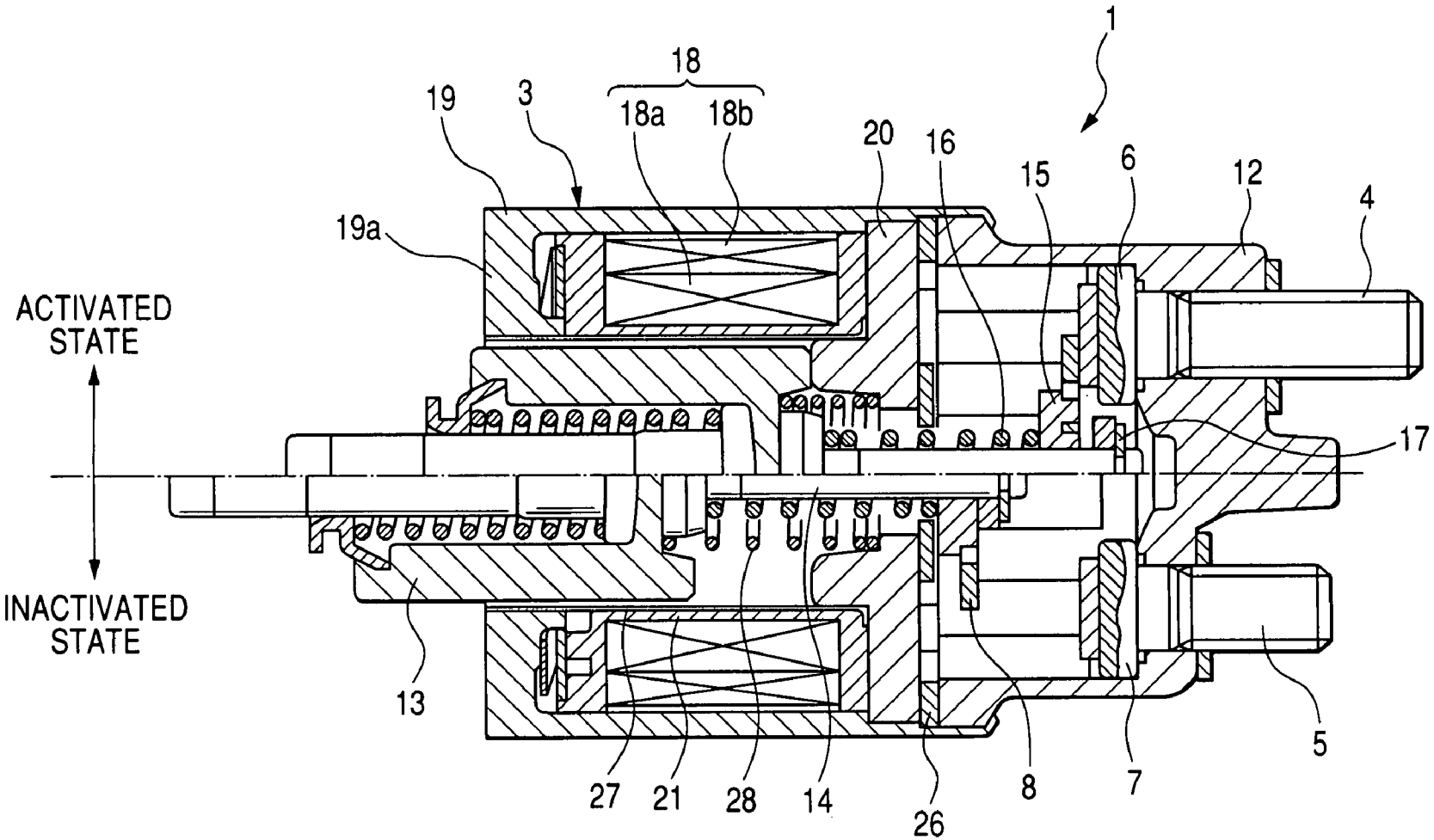
FIG. 3 is a longitudinal cross sectional view of the starter electromagnetic switch.

FIG. 1 is a side view of a starter electromagnetic switch 1 according to a first embodiment of the invention, FIG. 2 is a front view of the starter electromagnetic switch 1 viewed from the side of a switch cover 12 thereof, and FIG. 3 is a longitudinal cross sectional view of the starter electromagnetic switch 1. The starter electromagnetic switch 1 includes a main contact MS through which electric power is supplied to a starter motor 2 (see FIG. 4), and a solenoid 3 for opening and closing the main contact MS. The main contact MS is constituted by two stationary contacts 6, 7 connected to a motor circuit through two terminal bolts 4, 5, and a movable contact 8 movable in the direction to the stationary contacts 6, 7. To close the main contact MS, the stationary contacts 6, 7 are short-circuited through the movable contact 8. To open the main contact MS, the short circuit between the stationary contacts 6, 7 is removed.

Figure 4:
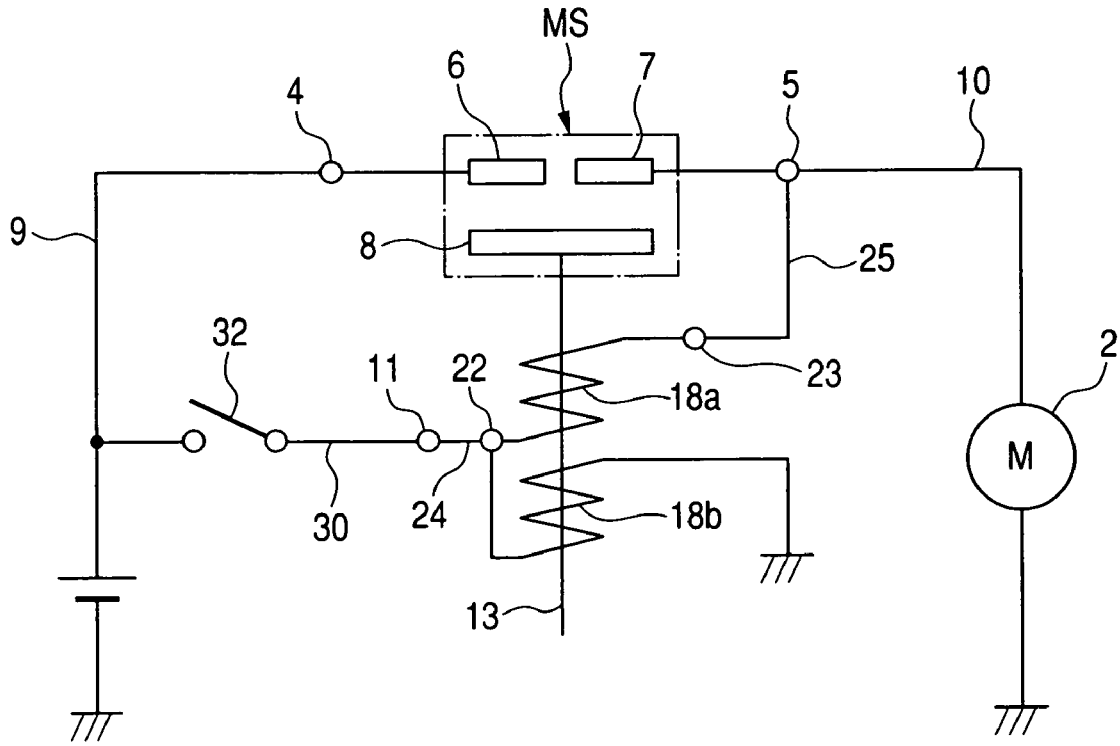
FIG. 4 is a circuit diagram of a starter provided with the starter electromagnetic switch.

The terminal bolt 4 serves as a battery terminal to which a battery cable 9 is connected (see FIG. 4), and the terminal bolt 5 serves as a motor terminal to which a lead cable 10 of the starter motor 2 is connected (see FIG. 4). As shown in FIG. 1, these terminals 4, 5 are fixed to the switch cover 12 together with a switch terminal bolt 11 (to be described later). As shown in FIG. 3, the stationary contacts 6, 7, which are integral with the head portions of the battery terminal 4 and the motor terminal 5, respectively, are located within a contact chamber formed inside the switch cover 12. The movable contact 8 is fitted, through an insulating member 15, to one end of a shaft 14 which is connected to a plunger 13 (to be described later) at the other end thereof, and is biased by a contact pressing spring 16 so as to be set in position by a stopper 17.

Figure 5:
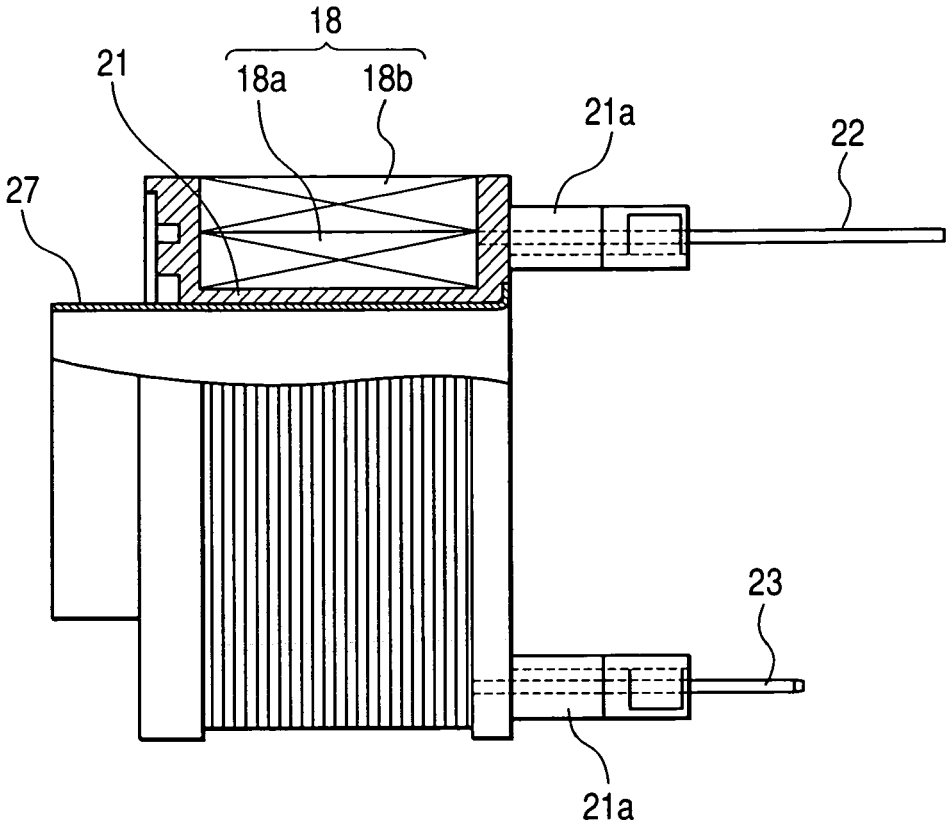
FIG. 5 is side view of a coil assembly of the starter electromagnetic switch.

As shown in FIG. 3, the solenoid 3 is constituted by a switch coil 18 which creates an attraction force when supplied with a current, a switch yoke 19, a stationary iron core 20, the plunger 13, etc. The switch yoke 19 and the stationary iron core 20 form a magnetic circuit. As shown in FIG. 5, the switch coil (coil assembly) 18 is constituted by an attracting coil 18*a* and a holding coil 18*b* wound around a bobbin 21 in two layers. These coils 18*a*, 18*b* are connected to a switch terminal 22 at their one ends. The attracting coil 18*a* is connected to a motor terminal 23 at the other end thereof. The other end of the holding coil 18*b* is grounded through the stationary iron core 20. One flange portion of the bobbin 21 is provided with two terminal holding parts 21*a* for holding the switch terminal 22 and the motor terminal 23.

Figure 6A:
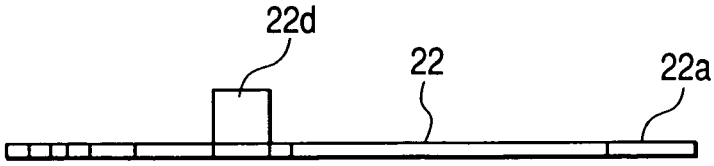
FIG. 6A is a side view of a switch terminal of the starter electromagnetic switch.
Figure 6B:
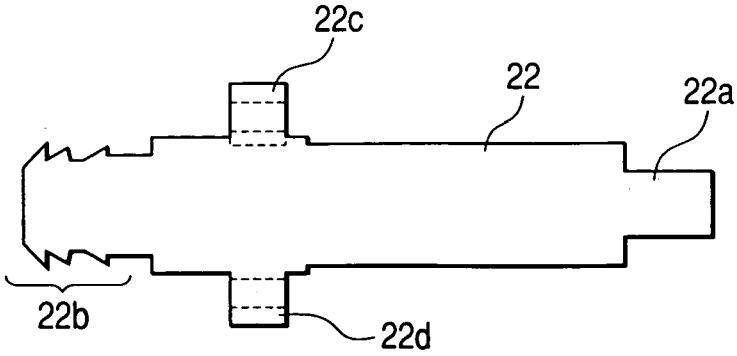
FIG. 6B is a plan view of the switch terminal.

As shown in FIGS. 6A, 6B, the switch terminal 22 has a plate-like shape. One end side of the switch terminal 22 is inserted into a slit aperture formed in one of the two terminal holding parts 21*a* of the bobbin 21. The switch terminal 22 has a connecting portion 22*a* formed at the other end side thereof for connection with a conducting plate 24 (to be described later). The one end side of the switch terminal 22 inserted into the slit aperture formed in the terminal holding parts 21*a* has serrated portions 22*b* formed in both sides thereof. The switch terminal 22 also has wire connecting portions 22*c*, 22*d* for connection with the one ends of the attracting coil 18*a* and the holding coil 22*d*. Although not shown, one end side of the motor terminal 23 is inserted into a slit aperture formed in the other of the two terminal holding parts 21*a*, and the other end side is electrically connected to the motor terminal 5 through a conducting plate 25 (see FIG. 2). The motor terminal 23 has a wire connecting portion for connection with the other end of the attracting coil 18*a*.

The switch yoke 19 having a cylindrical shape also serves as a solenoid casing. The stationary iron core 20, which is located in the opposite side of a bottom wall portion 19*a* of the switch yoke 19, that is, located in the side of the opening portion of the switch yoke 19, holds the switch coil 18 together with the bottom wall portion 19*a*. As shown in FIG. 3, the switch cover 12, which is fitted to the stationary iron core 20 through a packing 26, is crimped to the opening portion of the switch yoke 19. The plunger 13, which is located inside the bobbin 21 so as to be slidable on a sleeve 27 (see FIG. 5) fitted to the inner peripheral surface of the bobbin 21, is biased to the opposite side of the stationary iron core 20 (to the left side in this figure) by a return spring 28 located between the plunger 13 and the stationary iron core 20.

Figure 7A:
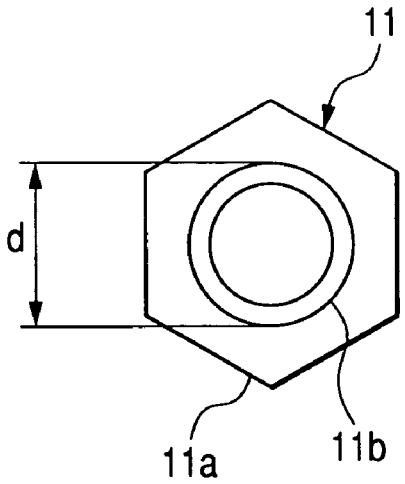
FIG. 7A is an axial front view of a switch terminal bolt of the starter electromagnetic switch.
Figure 7B:
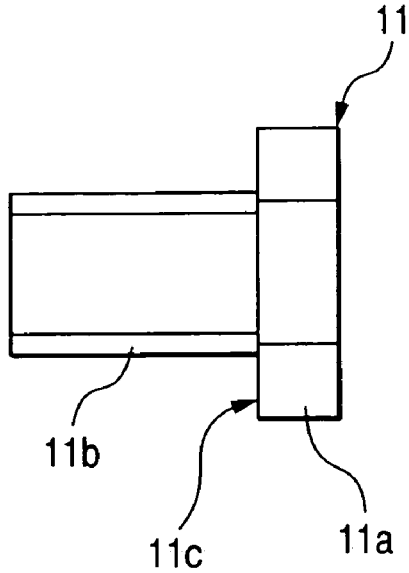
FIG. 7B is a side view of the switch terminal bolt of the starter electromagnetic switch.

Next, the switch terminal bolt 11 and the conducting plate 24 are explained. As shown in FIGS. 7A, 7B, the switch terminal bolt 11 has a head portion 11*a* of a hexagonal shape (referred to as hexagonal head 11*a* hereinafter), and a shaft 11*b* formed with a male thread. The hexagonal head 11*a* is insert-molded in the switch cover 12 made of resin. As shown in FIG. 1, not the whole of the hexagonal head 11*a* of the switch terminal bolt 11 is embedded in the switch cover 12, but the switch terminal bolt 11 is fixed to the switch cover 12 in such a state that one surface of the hexagonal head 11*a* on the side of the shaft 11*b* protrudes slightly (1 to 2 mm, for example) from the outer surface of the switch cover 12 as a bearing surface 11*c*.

During the insert molding of the switch terminal bolt 11, a rod-like jig is used for positioning and holding the hexagonal head 11*a* of the switch terminal bolt 11. The switch terminal bolt 11 is insert-molded in a state where the other surface of the hexagonal head 11*a*, which is on the opposite side of the shaft 11*b* is held in position by use of the jig, so that the bearing surface of the hexagonal head 11*a* can be set in a position slightly protruding from the outer surface of the switch cover 12. The switch cover 12 has a hole 29 (see FIG.

Figure 9:
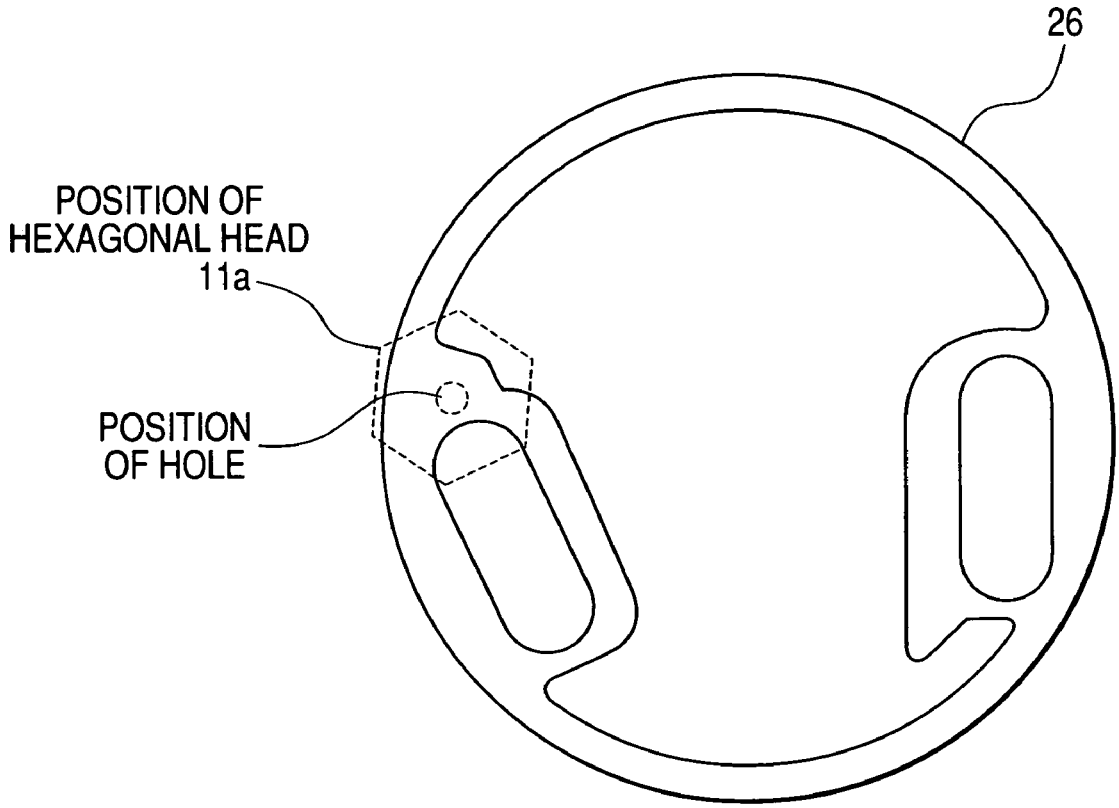
FIG. 9 is a plan view of a packing of the starter electromagnetic switch.

1) therein extending opposite to the shaft 11*b*. This hole is formed when the rod-like jig is pulled out after the hexagonal head 11*a* of the switch terminal bolt 11 is insert-molded. The opening of the hole 29 is closed by the packing 26 (see FIG. 9).

Figure 8A:
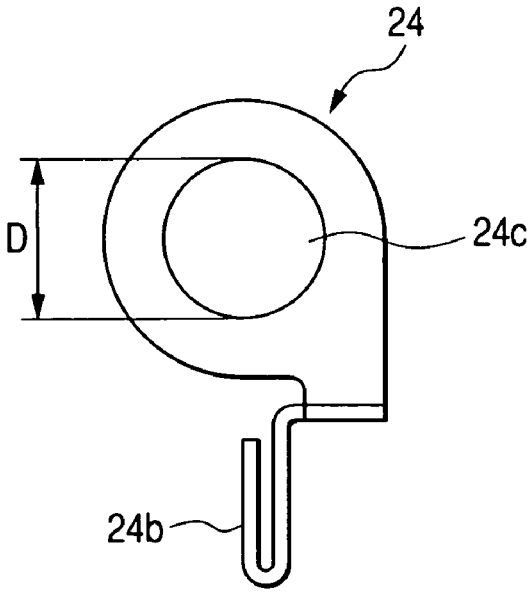
FIG. 8A is a plan view of a conducting plate of starter electromagnetic switch.
Figure 8B:
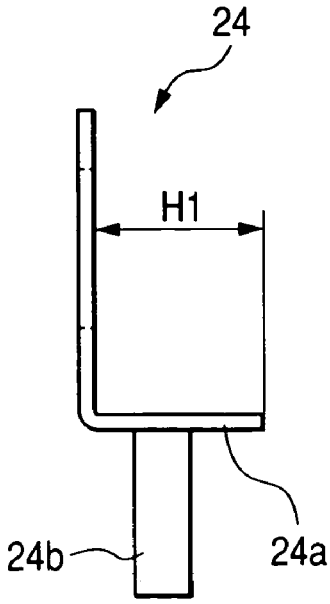
FIG. 8B is a side view of the conducting plate.

As shown in FIGS. 8A, 8B, the conducting plate 24 is bent in a thickness direction at a right angle to have an L shape. One end side of the conducting plate 24 has a plate-like insert portion 24*a* which is inserted into a slit groove (not shown) formed in the switch cover 12, and a junction portion for junction with the switch terminal 22. The other end side of the conducting plate 24 is formed with a circular mounting hole 24*c*. This mounting hole 24*c* has a diameter D larger than the outer diameter d of the shaft 11*b* of the switch terminal 11. The length H1 of the insert portion 24*a* is slightly (1 to 2 mm, for example) larger than the height h1 (see FIG. 1) between the bottom of the slit groove at which the front edge of the insert portion 24*a* inserted into this slit groove abuts and the bearing surface 11*c* of the switch terminal bolt 11.

The slit groove formed in the switch cover 12 has about the same size in cross section as the insert portion 24*a* of the conducting plate 24, so that, when the one end side of the conducting plate 24 is inserted into the slit groove, the position of the other end side of the conducting plate 24 in which the mounting hole 24*c* is formed can be fixed. More specifically, the other end side of the conducting plate 24 is set in such a position that the center of the mounting hole 24*c* and the center of the switch terminal bolt 11 are aligned to each other, so that the shaft 11*b* of the switch terminal bolt 11 can be passed through the mounting hole 24*c* without making contact therebetween, and the conducting plate 24 can be held in a state where a slight distance is kept between the other end side thereof and the bearing surface 11*c* of the switch terminal bolt 11.

Figure 10:
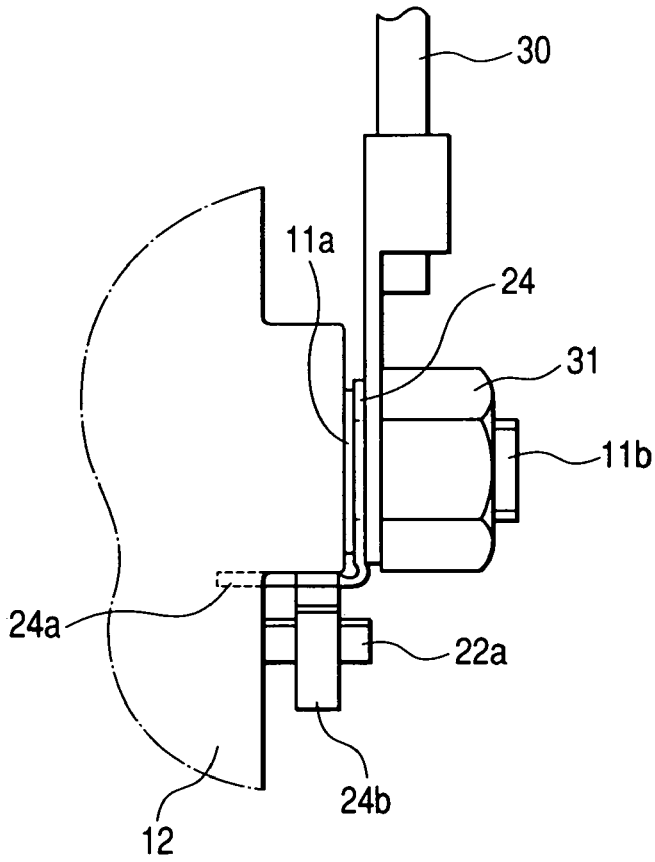
FIG. 10 is a diagram showing the switch terminal bolt to which a switch cable is fastened by a nut.

As shown in FIG. 8A, the junction portion 24*b* of the conducting plate 24 is formed by folding a rectangular plate into a U shape. The connecting portion 22*a* of the switch terminal 22 is put into the open space of the U shape, and electrically and mechanically connected to the junction portion 24*b* by heat crimping or the like. The switch terminal 22 extends from inside the switch cover 12 to expose outside the switch cover 12. As shown in FIG. 10, the conducting plate 24 is electrically connected to the switch terminal bolt 11 through a contact between the other end side of the conducting plate 24 and the bearing surface 11*c* of the switch terminal bolt 11, which is made by tightening a nut 31 to the shaft 11*b* of the switch terminal bolt 11 at the time of fastening a vehicle side switch cable 30 to the switch terminal bolt 11.

Next, the operation of the electromagnetic switch 1 having the above described structure is explained. Incidentally, the upper half above the center line in FIG. 3 shows an activated state where the plunger 13 is attracted by the stationary iron core 20, and the lower half below the center line shows an inactivated state where the plunger 13 is put back by the return spring 28. When a starter switch 32 (see FIG. 4) is turned on, and accordingly the switch coil 18 is supplied with a current, the stationary iron core 20 becomes magnetized, as a result of which the plunger 13 is moved to the stationary iron core 20 while compressing the return spring 20 to the right side in FIG. 3 by the magnetic attraction force between the plunger 13 and the stationary iron core 20. This movement of the plunger 13 causes the movable contact 8 held by the end of the shaft 14 to abut against the stationary contacts 6, 7 to thereby put the main contact MS in the closed state. When the starter switch 32 is turned off after the vehicle engine is started, and accordingly the supply of the current to the switch coil 18 is interrupted, the attraction force disappears, as a result of which the plunger 13 is put back by the compressive force of the return spring 20 to the left side to thereby put the main contact MS in the open state.

As explained above, the conducting plate 24 does not make electrical contact with the switch terminal bolt 11 until the vehicle side switch cable 30 is fastened to the switch terminal bolt 11 by tightening the nut 31 to the switch terminal bolt 11. Accordingly, even if the switch terminal bolt 11 is accidentally applied with a voltage, the switch coil 18 is not energized, and the electromagnetic switch 1 is not therefore activated. This makes it possible to prevent the plunger 1 from moving unintentionally.

Hence, with this embodiment, the work of mounting the starter on the vehicle can be performed safely, since there is no fear of the pinion (not shown) of the starter projecting unintentionally.

Also, since the switch terminal bolt 11 is fixed in such a state that the bearing surface 11*c* thereof slightly juts out of the outer surface of the switch cover 12, the other end side of the conducting plate 24 can make secure contact with the bearing surface 11*c* of the switch terminal bolt 11 when the nut 31 is tightened to the shaft 11*b* of the switch terminal bolt 11. Furthermore, since the hexagonal head 11*a* of the switch terminal bolt 11 is insert-molded in the switch cover 12, the switch terminal bolt 11 can be prevented from turning together with the nut 31 when the nut 31 is tightened to the switch terminal bolt 11.

Likewise, since the position of the conducting plate 24 is determined by the insert portion 24*a* thereof inserted into the slit groove formed in the switch cover 12, the conducting plate 24 can be prevented from turning together with the nut 31 when the nut 31 is tightened to the switch terminal bolt 11. Incidentally, the head portion of the switch terminal bolt 11 may have any polygonal shape other than the hexagonal shape, or a shape having at least one flat side, or an elliptic shape.

The switch coil 18 is connected to the conducting plate 24 through the switch terminal 22. More specifically, one end of each of the attracting coil 18*a* and the holding coil 18*b* is connected to the switch terminal 22 within the switch cover 12, the switch terminal 22 being extended outside the switch cover 12 to be electrically and mechanically connected to the junction portion 24*b* of the conducting plate 24. This configuration makes it possible to automate the installation process of the switch cover 12 and the conducting plate 24, because it is not necessary to pull the end of the switch coil 18 outside the switch cover 12.

Also, in this embodiment, it is not necessary to solder the conducting plate 24 to the switch terminal 22, because the connecting portion 22*a* of the switch terminal 22 is pinched and thermal crimped in the junction portion 24*b* of the conducting plate 24. Incidentally, it is possible to solder the conducting plate 24 to the switch terminal 22 by use of a soldering material not containing Pb which is an environmental load substance. However, since the solder material not containing Pb is lower than the solder material containing Pb in solder connection reliability, the solder material not containing Pb cannot be used for the electromagnetic switch 1 which is subjected to vibration, high temperature, and high humidity. Accordingly, it is preferable to connect the conducting plate 24 to the switch terminal 22 by thermal crimp in view of the connection reliability and environmental load.

As explained above, in this embodiment, the rod-like jig is used for positioning the hexagonal head 11*a* of the switch terminal bolt 11 when the switch terminal bolt 11 is insert-molded in the switch cover 12. Accordingly, the hole 29 is formed in the switch cover 12 when the rod-like jig is pulled out. The opening of the hole 29 is closed by the packing 26 put between the stationary iron core 20 and the switch cover 12. This makes is unnecessary to install a specific seal member for closing the opening of the hole 29, to thereby avoid increase of number of components.

Second Embodiment

Figure 11A:
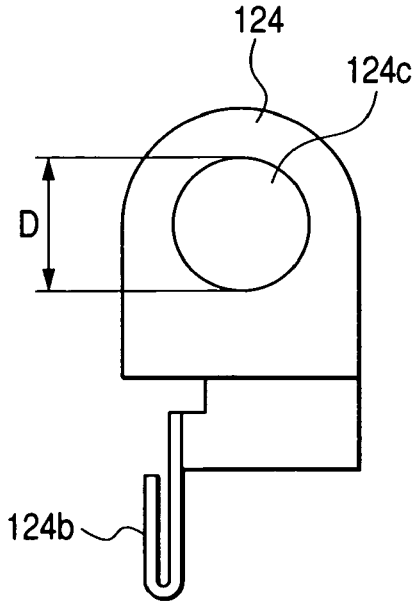
FIG. 11A is a plan view of a conducting plate of a starter electromagnetic switch according to a second embodiment of the invention.
Figure 11B:
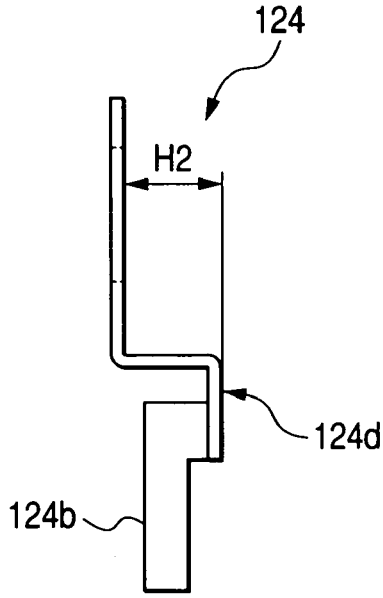
FIG. 11B is a side view of the conducting plate of the starter electromagnetic switch according to the second embodiment of the invention.

FIG. 11A is a plan view of a conducting plate 124 used in an electromagnetic switch according to a second embodiment of the invention, and FIG. 11B is a side view of the conducting plate 124. As shown in FIG. 11B, the conducting plate 124 is bent in a thickness direction to have a crank-like shape. The conducting plate 124 abuts against a supporting surface (not shown) formed in the switch cover 12 at one end side thereof, and is formed with a mounting hole 124*c* at the other end side thereof. As in the case of the first embodiment, the diameter D of the mounting hole 124*c* is set larger than the outer diameter d of the shaft 11*b* of the switch terminal bolt 11.

The bend height H2 of the conducting plate 124 is set larger than the height h2 (not shown) between the supporting surface of the switch cover 12 supporting the one end portion of the conducting plate 124 and the bearing surface 11*c* of the switch terminal bolt 11. Also, as in the case of the first embodiment, the conducting plate 124 is integrally provided with a junction portion 124*b* at the one end side thereof. On the other hand, the switch cover 12 is provided with a thick wall portion 12*s* which surrounds the one end side of the conducting plate 124 to fix the position of the other end side of the conducting plate 124.

According to the above described configuration, it is possible to keep a distance between the other end side of the conducting plate 124 and the bearing surface 11*c* of the switch terminal bolt 11*c* in a state where the one end side (flat surface 124*d*) is supported by the supporting surface of the switch cover 12. In addition, since the conducting plate 124 can be positioned accurately with respect to the switch cover 12, the shaft 11*b* of the switch terminal bolt 11 can be passed through the mounting hole 124*c* of the conducting plate 124 without making contact therebetween. Accordingly, even if the switch terminal bolt 11 is accidentally applied with a voltage, the switch coil 18 is not energized, and the electromagnetic switch 1 is not therefore activated. Hence, the work of mounting the starter on the vehicle can be performed safely, since there is no fear of the pinion (not shown) of the starter projecting unintentionally. Furthermore, the above described configuration makes it possible to prevent the conducting plate 124 from turning together with the nut 31 when the nut 31 is tightened to the switch terminal bolt 11 as in the case of the first embodiment.

It is a matter of course that various modifications can be made to the above described embodiment as described below. In the first embodiment, the switch terminal bolt 11 is fixed in the state where the surface of the hexagonal head thereof on the side of the shaft thereof slightly protrudes from the outer surface of the switch cover 12 so as to serve as the bearing surface 11*c*. However, the switch terminal bolt 11 may be fixed in such a state that only the shaft 11*b* thereof protrudes from the outer surface of the switch cover 12 with the conducting plate 24 being connected to the shaft 11*b* through a washer one surface of which in contact with the conducting plate 24 serves as the bearing surface. In this case, the conducting plate 24 is pinched between the washer and the nut 31 by tightening the nut 31 to the shaft 11*b* of the switch terminal bolt 11.

The above explained preferred embodiments are exemplary of the invention of the present application which is described solely by the claims appended below. It should be understood that modifications of the preferred embodiments may be made as would occur to one of skill in the art.

What is claimed is:

1. A starter electromagnetic switch having a main contact through which electric power is supplied to a motor starter of a vehicle engine, said electromagnetic switch comprising:

a switch coil creating a magnetic force to move a plunger slidably disposed in said switch coil for closing said main contact when a current is supplied to said switch coil;

a switch terminal bolt having a head portion fixed to a switch cover made of insulating material and covering said main contact, and a shaft portion to which a vehicle side switch cable is fastened by tightening a nut to said shaft portion; and a conducting plate located outside said switch cover for electrically connecting said switch coil and said switch terminal bolt to each other;

wherein said conducting plate has a mounting hole formed in one end side thereof, said shaft portion being passed through said mounting hole without making contact with said conducting plate, said conducting plate being supported by said switch cover in a state where a certain distance is kept between said one end side of said conducting plate and a bearing surface of said switch terminal bolt when said nut is not tightened to said shaft portion of said switch terminal bolt.

2. The starter electromagnetic switch according to claim 1, wherein a surface of said head portion of said switch terminal bolt on the side of said shaft portion serves as said bearing surface, said head portion being partially embedded in said switch cover in a state where said bearing surface projects from an outer surface of said switch cover.

3. The starter electromagnetic switch according to claim 2, wherein said conducting plate is bent in a thickness direction to have a crank-like shape, one end side of said conducting plate being held in a supporting surface of said switch cover, the other end side of said conducting plate having said mounting hole formed therein, a bend height of said conducting plate is larger than a height between said supporting surface of said switch cover and said bearing surface of said switch terminal bolt.

4. The starter electromagnetic switch according to claim 3, wherein said switch cover has a wall portion formed in said outer surface thereof, said wall portion surrounding said one end side of said conducting plate to fix a position of said other end side of said conducting plate.

5. The starter electromagnetic switch according to claim 2, wherein said conducting plate is bent in a thickness direction to have an L-like shape, one end side of said conducting plate being inserted into a slit groove formed in said outer surface of said switch cover, the other end side of said conducting plate having said mounting hole formed therein, a length of said one end side being larger than a height between a bottom surface at which a front edge of said one end side abuts and said bearing surface of said switch terminal bolt.

6. The starter electromagnetic switch according to claim 5, wherein said slit groove formed in said outer surface of said switch cover has substantially the same size in cross section as said other end side of said conducting plate.

7. The starter electromagnetic switch according to claim 1, wherein said switch cover has a hole therein extending opposite to said shaft portion of said switch terminal bolt, said hole being formed by pulling out a rod-like jig used for positioning said head portion of said switch terminal bolt when said switch terminal bolt is insert-molded in said switch cover, said hole being closed by a sealing packing put between said switch cover and a solenoid casing containing said switch coil.

8. The starter electromagnetic switch according to claim 1, wherein said head portion of said switch terminal bolt has such a shape that prevents said switch terminal bolt from turning together with said nut when said nut is tightened to said shaft portion of said switch terminal bolt.

9. The starter electromagnetic switch according to claim 1, further comprising a switch terminal to which an end of said switch coil is connected within said switch cover, one end of said switch terminal being extended to expose outside said switch cover, said conducting plate having a junction portion by which said one end of said switch terminal is pinched for electrical and mechanical connection with said conducting plate.

10. The starter electromagnetic switch according to claim 9, wherein said one end of said switch terminal is heat-crimped to said junction portion.

* * * * *